US011384645B2

(12) United States Patent
Hiwatashi et al.

(10) Patent No.: US 11,384,645 B2
(45) Date of Patent: Jul. 12, 2022

(54) TURBINE WHEEL

(71) Applicant: Mitsubishi Power, Ltd., Yokohama (JP)

(72) Inventors: Shosaku Hiwatashi, Yokohama (JP); Yasuyuki Watanabe, Yokohama (JP); Tadashi Murakata, Yokohama (JP); Yoshiki Sakamoto, Yokohama (JP)

(73) Assignee: Mitsubishi Power, Ltd., Yokohama (JP)

( * ) Notice: Subject to any disclaimer, the term of this patent is extended or adjusted under 35 U.S.C. 154(b) by 0 days.

(21) Appl. No.: 17/160,034

(22) Filed: Jan. 27, 2021

(65) Prior Publication Data

US 2021/0246799 A1 Aug. 12, 2021

(30) Foreign Application Priority Data

Feb. 10, 2020 (JP) ..... JP2020-020333

(51) Int. Cl.
*F01D 5/26* (2006.01)

(52) U.S. Cl.
CPC ..... *F01D 5/26* (2013.01); *F05D 2220/30* (2013.01); *F05D 2240/24* (2013.01); *F05D 2260/96* (2013.01)

(58) Field of Classification Search
CPC .... F01D 5/26; F05D 2220/30; F05D 2240/24; F05D 2260/96
See application file for complete search history.

(56) References Cited

U.S. PATENT DOCUMENTS 3,736,811 A 6/1973 Neary
4,477,226 A * 10/1984 Carreno ..... F16F 15/32 416/500
4,817,455 A * 4/1989 Buxe ..... F01D 5/027 416/500

(Continued)

FOREIGN PATENT DOCUMENTS

JP 48-64601 U1 8/1971

*Primary Examiner* — J. Todd Newton
*Assistant Examiner* — Theodore C Ribadeneyra
(74) *Attorney, Agent, or Firm* — Crowell & Moring LLP

(57) ABSTRACT

A turbine wheel is provided with a groove having a bottom surface and a pair of side wall surfaces. The turbine wheel includes: a balance weight that is arranged in the groove, is insertable from any circumferential position of the opening of the groove, and has a through-hole opened toward one of the pair of side wall surfaces; and a retaining member that contacts the one of the pair of side wall surfaces in a state of being inserted in the through-hole of the balance weight, to thereby cause the balance weight to abut against the other one of the pair of side wall surfaces and be retained in the groove. The groove has engagement recesses provided at intervals in a circumferential direction at the bottom surface or an engagement protrusion fitted to one of fitting recesses provided at intervals in the circumferential direction at the bottom surface and protruding from the bottom surface. The balance weight has an engagement protrusion or an engagement groove that engages with one of the engagement recesses or the engagement protrusion of the groove, to thereby restrict a circumferential shift of the balance weight in the groove.

5 Claims, 11 Drawing Sheets

(56) References Cited

U.S. PATENT DOCUMENTS

| | | | | |
|---|---|---|---|---|
| 4,842,485 | A * | 6/1989 | Barber | F01D 5/027 411/84 |
| 4,895,047 | A * | 1/1990 | George | F16F 15/167 74/573.11 |
| 6,279,420 | B1 * | 8/2001 | Knorowski | F16F 15/322 409/234 |
| 7,284,460 | B2 * | 10/2007 | Yamamoto | F16F 15/36 74/573.1 |
| 8,177,487 | B2 * | 5/2012 | Koza | F16F 15/34 415/119 |
| 9,017,029 | B2 * | 4/2015 | Pichel | F01D 5/027 416/144 |
| 9,260,977 | B2 * | 2/2016 | Milner | F01D 1/24 |
| 9,593,581 | B2 * | 3/2017 | Brathwaite | F01D 11/02 |
| 9,938,832 | B2 * | 4/2018 | Bakker | F01D 5/027 |
| 10,697,300 | B2 * | 6/2020 | Rosborough | H02K 15/165 |
| 2002/0028141 | A1 * | 3/2002 | Berry | F16F 15/34 416/145 |

* cited by examiner 30
31
31
R
A
40
32
40
41
43
33
41'
43

TURBINE WHEEL

BACKGROUND OF THE INVENTION

1. Field of the Invention

The present invention relates to a turbine wheel of a gas turbine, and in particular relates to a turbine wheel including a balance weight.

2. Description of the Related Art

A gas turbine generally includes: a compressor that compresses air to generate compressed air; a combustor that mixes the compressed air from the compressor with fuel, and combusts the mixture to generate a combustion gas; and a turbine that obtains shaft power by the combustion gas from the combustor. The turbine includes a turbine rotor that converts the kinetic energy of the combustion gas into rotational power. In the turbine, it is necessary to adjust the balance of the turbine rotor in order to reduce vibrations during its rotation. Examples of the method of adjusting the balance of the turbine rotor include a method in which a portion of a component of the turbine rotor is machined, and a method in which a balance weight is attached to a component of the turbine rotor.

In the technology of adjusting the balance of the turbine rotor by attaching the balance weight, typically, at least one balance weight is arranged at an appropriate position, in the circumferential direction, in an annular dovetail groove provided at the wall surface of the turbine wheel (see JP 48-064601 U1 (1971), for example). JP 48-64601 U1 discloses that a balance weight attachment for turbine wheels is formed such that it can be inserted in any position in a dovetail-shaped annular groove formed on a turbine wheel without providing an access slot. The balance weight is retained in the annular groove of the turbine wheel with a projection of one side of its body portion abutted against one side of the annular groove when fastening means is inserted in an oblique passageway that is opened on the other side of the body portion and loads against the other side of the annular groove.

Meanwhile, since a gas turbine obtains shaft power of a turbine rotor from a high-temperature and high-pressure combustion gas, it is necessary to cool each part of the turbine rotor such as turbine wheels or turbine rotor blades by cooling air, and to suppress a temperature increase of each part. In the gas turbine, typically, compressed air bled from a compressor is used as the cooling air. In this case, increasing the flow rate of the cooling air means increasing the flow rate of the compressed air bled from the compressor. Accordingly, if the flow rate of the cooling air is increased, the flow rate of the combustion gas to drive the turbine rotor decreases by a corresponding amount, and thus the overall efficiency of the gas turbine deteriorates.

One of the effective means for attaining high efficiency of a gas turbine is to reduce cooling air used to cool each part of a turbine rotor. In this case, the ambient temperature in a wheel space formed in front and rear of the turbine wheel in the axial direction increases. In view of this, it has been proposed to change the material of a turbine wheel to a Ni based alloy that is more heat-resistant than conventionally used 12Cr steel materials. It should be noted however that there is a concern that cracks due to the residual tensile stress occur if parts formed of a Ni based alloy material are used in a high temperature environment in a state in which they are receiving a residual tensile stress.

In the technology described in JP 48-064601 U1, the balance weight is retained in the annular groove of the turbine wheel with the projection of the balance weight abutted against the one side of the annular groove when the fastening means is inserted in the oblique passageway of the balance weight and loads against the other side of the annular groove. In the technology of retaining the balance weight in the annular groove in this manner, an opening edge portion of the annular groove of the turbine wheel is crimped in some cases in order to inhibit a circumferential shift of the balance weight along the annular groove. In this case, a residual tensile stress is generated in and around the crimped portion of the turbine wheel.

In a case where not a 12Cr steel material, but a Ni based alloy material is applied to a turbine wheel for which a method, like the one mentioned above, of inhibiting the shift of a balance weight by crimping a portion of the turbine wheel is employed, there is a concern over occurrences of cracks in the turbine wheel due to a residual tensile stress generated by the crimping.

The present invention has been made in order to solve the problems described above, and an object of the present invention is to provide a turbine wheel that can suppress a residual tensile stress caused in a turbine wheel by fixing a balance weight.

SUMMARY OF THE INVENTION

The present application includes a plurality of means for solving the problems described above, and one example thereof is a turbine wheel provided with a groove having a bottom surface extending circumferentially and a pair of side wall surfaces forming an opening. The turbine wheel including: a balance weight that is arranged in the groove, is configured to be insertable from any circumferential position of the opening of the groove, and has a through-hole opened toward one of the pair of side wall surfaces of the groove; and a retaining member that contacts a portion of the one of the pair of side wall surfaces of the groove in a state of being inserted in the through-hole of the balance weight, to thereby cause the balance weight to abut against other one of the pair of side wall surfaces of the groove and be retained in the groove. The groove has a plurality of engagement recesses provided at intervals in a circumferential direction at the bottom surface; or an engagement protrusion fitted to one of a plurality of fitting recesses provided at intervals in the circumferential direction at the bottom surface and protruding from the bottom surface. The balance weight has an engagement protrusion that engages with one of the engagement recesses of the groove to restrict a circumferential shift of the balance weight in the groove or an engagement groove that engages with the engagement protrusion of the groove to restrict a circumferential shift of the balance weight in the groove.

According to the present invention, since the engagement protrusion or the engagement groove of the balance weight engages with the engagement recess or the engagement protrusion in the groove of the turbine wheel, the circumferential shift of the balance weight within the groove is restricted, and thus it becomes unnecessary to crimp the turbine wheel in order to fix the balance weight. Accordingly, it is possible to suppress a residual tensile stress caused in the turbine wheel by fixing the balance weight.

Problems, configurations and effects other than those described above become apparent from the following explanation of embodiments.

DESCRIPTION OF THE PREFERRED EMBODIMENTS

In the following, embodiments of a turbine wheel according to the present invention are explained by using the drawings.

First Embodiment

Figure 1:
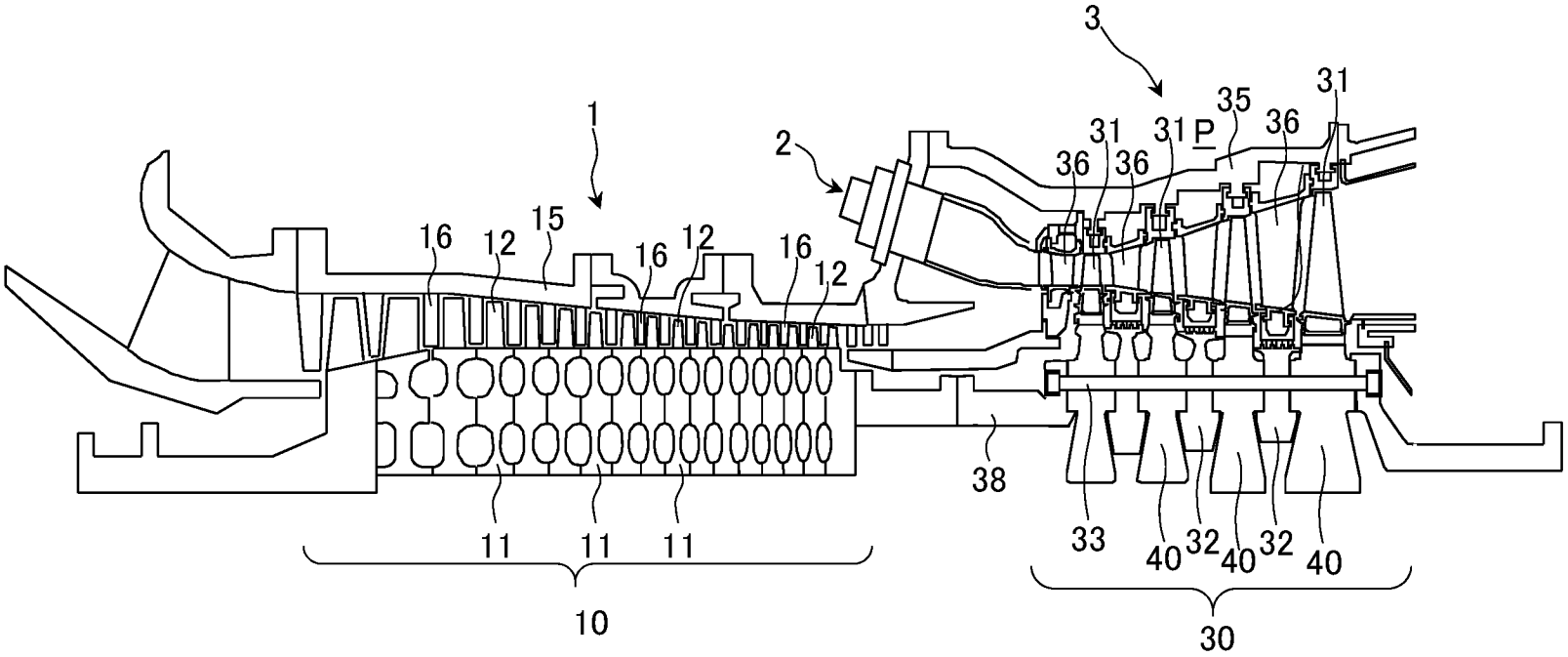
FIG. 1 is a cross-sectional diagram illustrating a gas turbine including a turbine wheel according to a first embodiment of the present invention in a state in which a lower half section is omitted therefrom.
Figure 2:
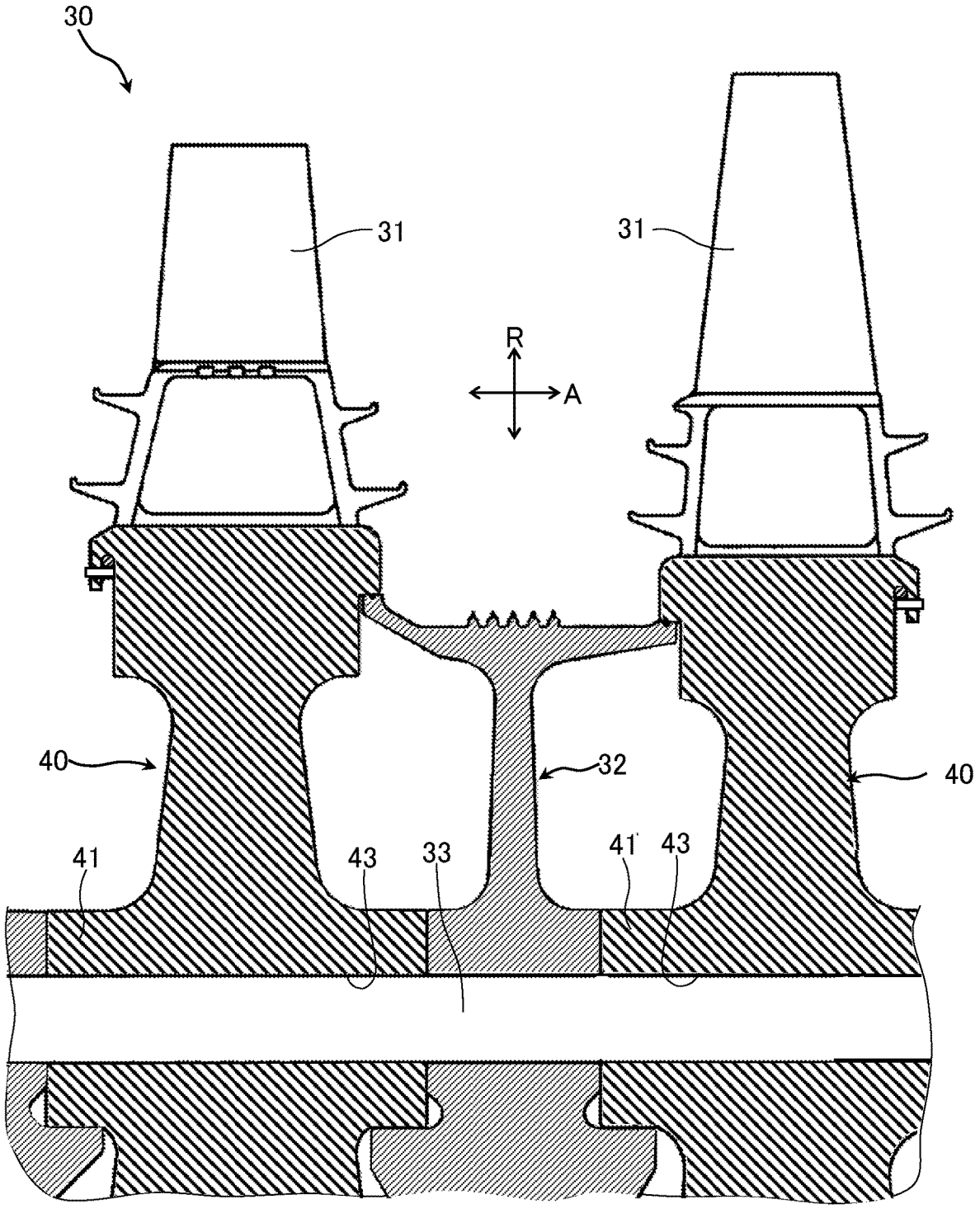
FIG. 2 is an enlarged cross-sectional diagram illustrating a portion of a turbine rotor including the turbine wheel according to the first embodiment of the present invention illustrated in FIG. 1.

First, the configuration of a gas turbine including a turbine wheel according to a first embodiment of the present invention is explained by using FIG. 1 and FIG. 2. FIG. 1 is a cross-sectional diagram illustrating the gas turbine including the turbine wheel according to the first embodiment of the present invention in a state in which a lower half section is omitted therefrom. FIG. 2 is an enlarged cross-sectional diagram illustrating a portion of a turbine rotor including the turbine wheel according to the first embodiment of the present invention illustrated in FIG. 1.

In FIG. 1, the gas turbine includes a compressor 1, a combustor 2 and a turbine 3. The compressor 1 compresses air taken in to generate compressed air. The combustor 2 mixes the compressed air generated by the compressor 1 with fuel from a fuel system (not illustrated), and combusts the mixture to generate a combustion gas. The gas turbine has a multi-can type combustor, for example, and in the multi-can type, a plurality of combustors 2 are annularly arranged at intervals. The turbine 3 is rotation-driven by the high temperature and high-pressure combustion gas generated at the combustor 2 to drive the compressor 1 and a load (a driven device such as a generator, a pump, and a process compressor) which is not illustrated. The turbine 3 is supplied with compressed air bled from the compressor 1 as cooling air to cool components of the turbine 3.

The compressor 1 includes: a compressor rotor 10 that is rotation-driven by the turbine 3; and a compressor casing 15 that houses the compressor rotor 10 such that compressor rotor 10 can rotate therein. The compressor 1 is an axial compressor, for example. The compressor rotor 10 includes: a plurality of disc-like compressor wheels 11 stacked in the axial direction; and a plurality of compressor rotor blades 12 that are coupled to an outer circumferential edge portion of each compressor wheel 11. In the compressor rotor 10, the plurality of compressor rotor blades 12 arrayed annularly at the outer circumferential edge portion of each compressor wheel 11 form one compressor rotor blade row.

A plurality of compressor stator blades 16 are arrayed annularly downstream side of a working fluid from each compressor rotor blade row. The plurality of compressor stator blades 16 arrayed annularly form one compressor stator blade row. The compressor stator blade rows are fixed inside the compressor casing 15. In the compressor 1, each compressor rotor blade row, and each compressor stator blade row located immediately downstream of the compressor rotor blade row form one stage.

The turbine 3 includes: a turbine rotor 30 that is rotation-driven by the combustion gas from the combustor 2; and a turbine casing 35 that houses the turbine rotor 30 such that the turbine rotor 30 can rotate therein. The turbine 3 is an axial turbine. A flow passage P through which the combustion gas flows is formed between the turbine rotor 30 and the turbine casing 35.

As illustrated in FIG. 1 and FIG. 2, the turbine rotor 30 is built by alternately stacking, in the axial direction, a plurality of disc-like turbine wheels 40 having a plurality of turbine rotor blades 31 coupled thereto circumferentially at an outer circumferential edge portion, and a plurality of disc-like spacers 32. The stacked turbine wheels 40 and spacers 32 are fixed by stacking bolts 33. In the turbine rotor 30, a plurality of turbine rotor blades 31 arrayed annularly at an outer circumferential edge portion of each turbine wheel 40 form one turbine rotor blade row. Each turbine rotor blade row is disposed in the flow passage P.

A plurality of turbine stator blades 36 are arrayed annularly upstream of the working fluid from each turbine rotor blade row. The plurality of turbine stator blades 36 arrayed annularly form one turbine stator blade row. The turbine stator blade rows are fixed inside the turbine casing 35, and are disposed in the flow passage P. In the turbine 3, each turbine stator blade row, and each turbine rotor blade row located immediately downstream of the turbine stator blade row form one stage.

The turbine rotor 30 is connected to the compressor rotor 10 via an intermediate shaft 38. The turbine casing 35 is connected to the compressor casing 15.

Figure 3:
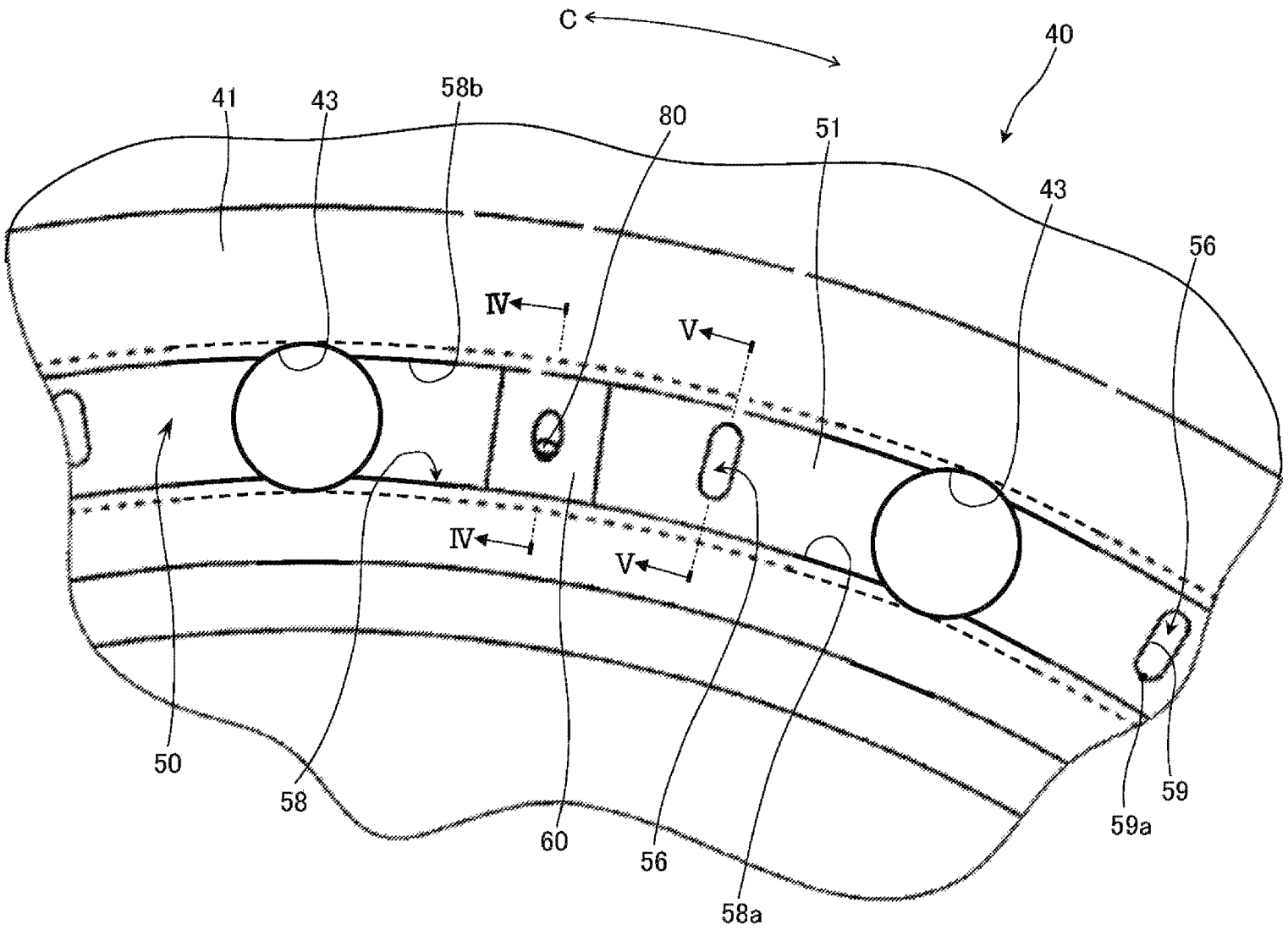
FIG. 3 is an enlarged view of an attachment structure of a balance weight of the turbine wheel according to the first embodiment of the present invention as seen in the axial direction.
Figure 4:
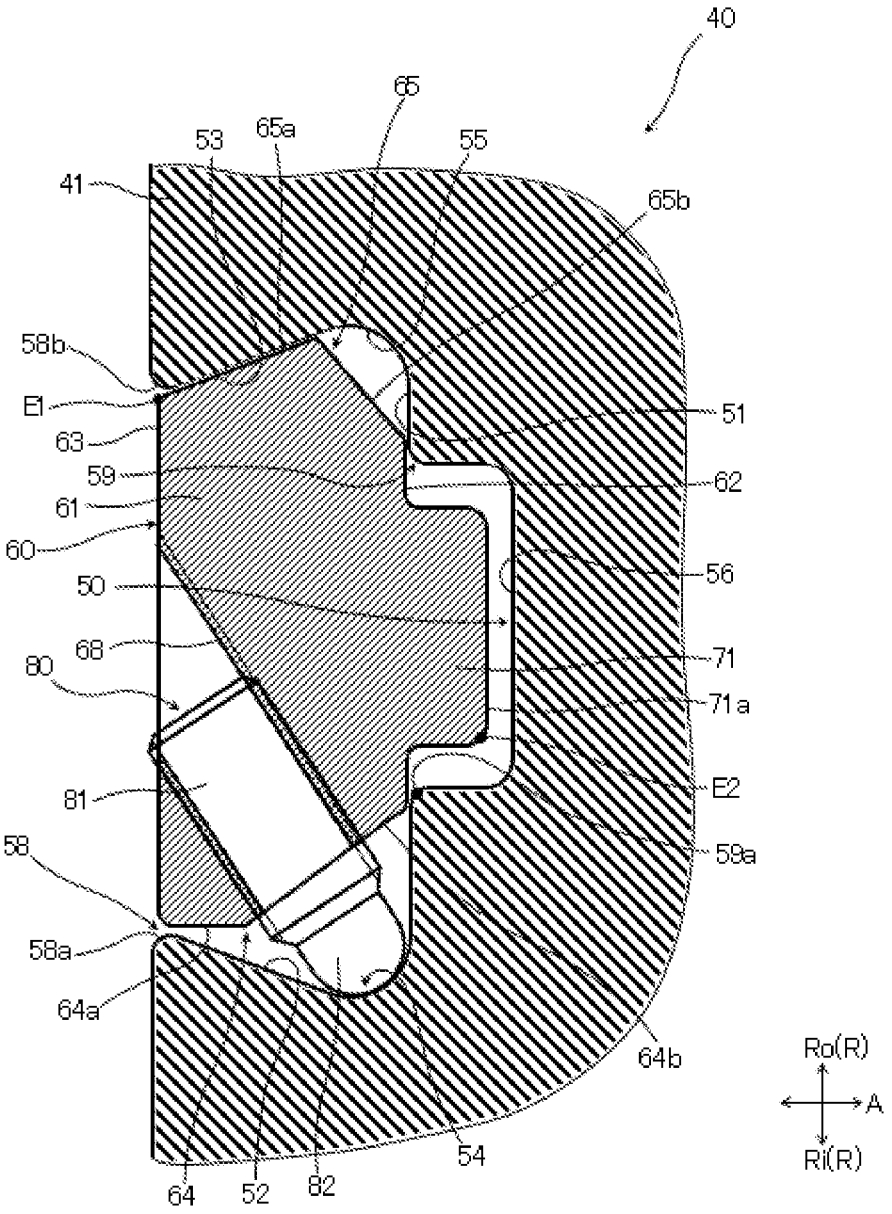
FIG. 4 is a cross-sectional diagram illustrating the fixed state of the balance weight in a groove of the turbine wheel according to the first embodiment of the present invention illustrated in FIG. 3 as seen in the direction of arrows IV-IV.
Figure 5:
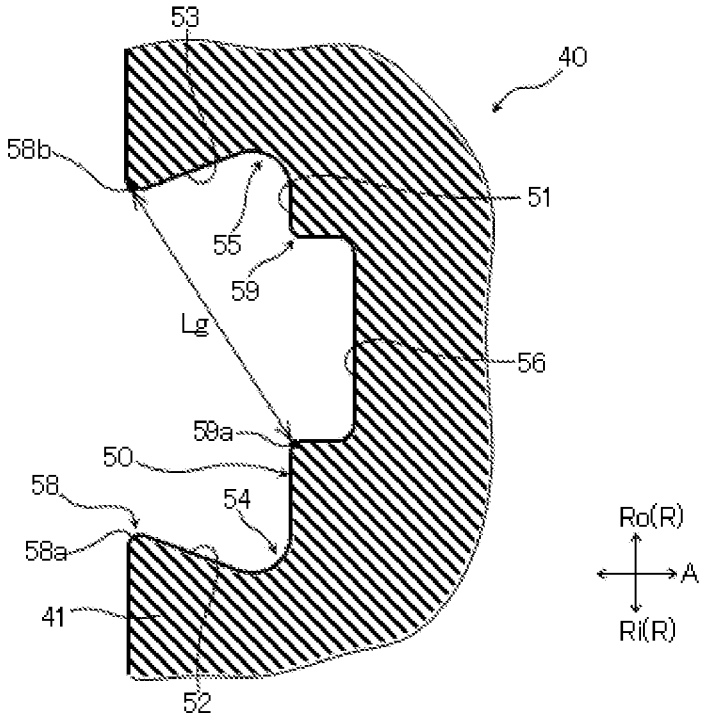
FIG. 5 is a cross-sectional diagram of the groove of the turbine wheel according to the first embodiment of the present invention illustrated in FIG. 3 as seen in the direction of arrows V-V.
Figure 6:
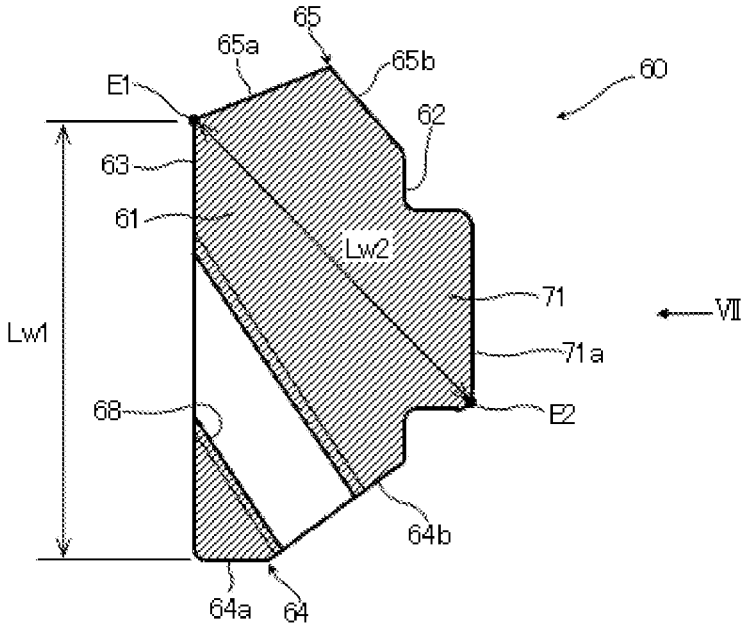
FIG. 6 is a cross-sectional diagram of the balance weight of the turbine wheel according to the first embodiment of the present invention.
Figure 7:
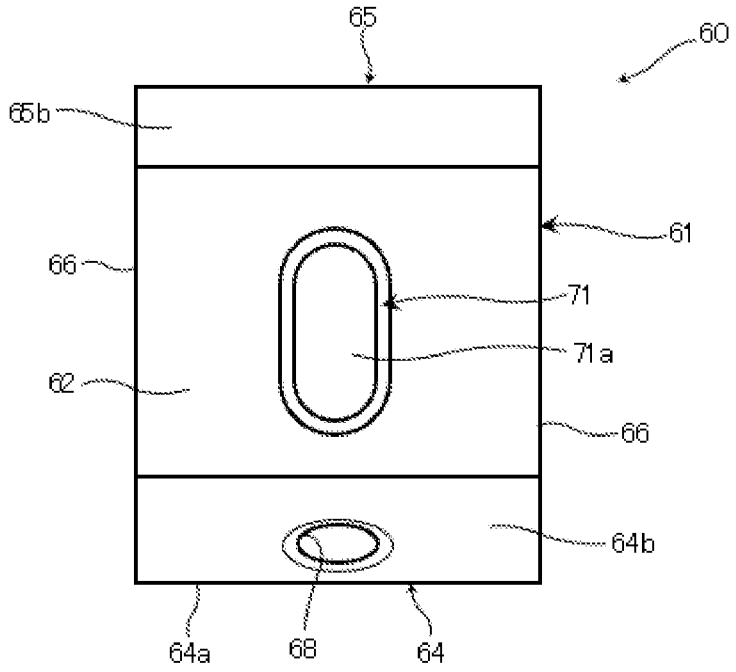
FIG. 7 is a diagram of the balance weight of the turbine wheel according to the first embodiment of the present invention illustrated in FIG. 6 as seen in the direction of an arrow VII.
Figure 8:
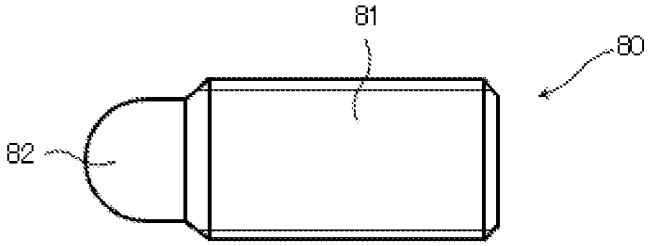
FIG. 8 is a front view illustrating a retaining member of the turbine wheel according to the first embodiment of the present invention.

Next, the configuration and structure of the turbine wheel according to the first embodiment of the present invention are explained by using FIG. 2 to FIG. 8. FIG. 3 is an enlarged view of an attachment structure of a balance weight of the turbine wheel according to the first embodiment of the present invention as seen in the axial direction. FIG. 4 is a cross-sectional diagram illustrating the fixed state of the balance weight in a groove of the turbine wheel according to the first embodiment of the present invention illustrated in FIG. 3 as seen in the direction of arrows IV-IV. FIG. 5 is a cross-sectional diagram of the groove of the turbine wheel according to the first embodiment of the present invention illustrated in FIG. 3 as seen in the direction of arrows V-V. FIG. 6 is a cross-sectional diagram of the balance weight of the turbine wheel according to the first embodiment of the present invention. FIG. 7 is a diagram of the balance weight of the turbine wheel according to the first embodiment of the present invention illustrated in FIG. 6 as seen in the direction of an arrow VII. FIG. 8 is a front view illustrating a retaining member of the turbine wheel according to the first embodiment of the present invention.

In FIG. 2 and FIG. 3, the turbine wheels 40 are formed with a Ni based alloy as their base material. An annular thicker portion 41 at an intermediate section in a radial direction R of a turbine wheel 40 is provided with bolt holes 43 that penetrates the thicker portion 41 in an axial direction A (the thickness direction of the turbine wheel 40). The bolt holes 43 are provided at predetermined intervals in a circumferential direction C. A stacking bolt 33 is inserted into each bolt hole 43.

In addition, as illustrated in FIG. 3, on the end surface of the thicker portion 41 of the turbine wheel 40 in the axial direction A, a groove 50 is formed such that it extends in the circumferential direction C of the turbine wheel 40. The groove 50 intermittently extends over the entire circumference of the turbine wheel 40 such that the bolt holes 43 are sandwiched between parts of the groove 50, for example. A balance weight 60 is arranged in the groove 50 for the balance adjustment of the turbine rotor 30 (see FIG. 2). A plurality of balance weights 60 are arranged in the groove 50 as necessary in some cases. The balance weight 60 is retained in the groove 50 by a retaining screw member 80 as a retaining member.

As illustrated in FIG. 4 and FIG. 5, the groove 50 is formed such that the width (the length in the upward/downward direction or the radial direction R in FIG. 4 and FIG. 5) of a bottom surface 51 is larger than the width (the length in the upward/downward direction or the radial direction R in FIG. 4 and FIG. 5) of an opening 58, and is formed like a dovetail groove, for example. The groove 50 is formed such that the width of the bottom surface 51 and the width of the opening 58 are each approximately the same in the circumferential direction C, for example.

The groove 50 has the flat bottom surface 51 that is approximately parallel to the end surface, in the axial direction A, of the thicker portion 41 of the turbine wheel 40, and a first side wall surface 52 and a second side wall surface 53 as a pair of side wall surfaces that form the opening 58 and is closer to each other on a direction away from the bottom surface 51 (leftward direction in FIG. 4 and FIG. 5). The first side wall surface 52 is inclined such that it is gradually positioned radially outward Ro as it comes from the side where the bottom surface 51 is located toward the side where the opening 58 is located. On the other hand, the second side wall surface 53 is inclined such that it is gradually positioned radially inward Ri as it comes from the side where the bottom surface 51 is located toward the side where the opening 58 is located, and is positioned radially outward Ro relative to the first side wall surface 52.

A first corner portion 54 between the first side wall surface 52 and the bottom surface 51 is formed as a concave curved surface. The concave curved surface of the first corner portion 54 has a predetermined radius of curvature in its cross-sectional shape, for example. Similarly to the first corner portion 54, a second corner portion 55 between the second side wall surface 53 and the bottom surface 51 is formed as a concave curved surface having a predetermined radius of curvature in its cross-sectional shape.

As illustrated in FIG. 3 to FIG. 5, a plurality of engagement recesses 56 are provided at intervals in the circumferential direction C on the bottom surface 51 of the groove 50. The engagement recesses 56 are configured to engage with engagement protrusion 71, which is mentioned below, of the balance weight 60, and have the function of restricting the shift of the balance weight 60 in the groove 50 in the circumferential direction C (the extending direction of the groove 50). The engagement recesses 56 are formed as grooves (engagement grooves) that extend in the groove widthwise direction of the groove 50 (in the upward/downward direction or the radial direction R in FIG. 4 and FIG. 5), for example. As illustrated in FIG. 5, in a meridional cross-section of the turbine wheel 40 including an engagement recess 56, a length Lg from an opening edge 58*b*, which is on a side where the second side wall surface 53 is located, of the opening 58 of the groove 50 to an end section 59*a*, which is on a side where a first side wall surface 52 is located, of an opening edge 59 of the engagement recess 56 in the groove 50 is set to a predetermined length.

In FIG. 3 and FIG. 4, the balance weight 60 is formed such that it is insertable from any position, in the circumferential direction C, of the opening 58 of the groove 50 of the turbine wheel 40. In addition, the balance weight 60 is formed such that it abuts against the second side wall surface 53 of the groove 50, and engages with the engagement recess 56 of the groove 50.

Specifically, as illustrated in FIG. 4, the balance weight 60 includes a body section 61 to be arranged between the first side wall surface 52 and second side wall surface 53 of the groove 50, and an engagement protrusion 71 formed integrally with the body section 61. The body section 61 is a portion to abut against the second side wall surface 53 of the groove 50, and has the function of restricting the shift of the balance weight 60 in the groove 50 in the radial direction R (the groove widthwise direction of the groove 50). The engagement protrusion 71 is a portion to engage with any one of the engagement recesses 56 of the groove 50, and has the function of restricting the shift of the balance weight 60 in the groove 50 in the circumferential direction C (the extending direction of the groove 50).

A side portion of the body section 61 on a side where the second side wall surface 53 of the groove 50 is located is formed in a shape that is approximately complementary to the groove shape of the groove 50, and has a shape that can make surface contact with (abut against) the second side wall surface 53 of the groove 50. In addition, the side portion on the second side wall surface 53 side of the body section 61 is shaped such that a portion corresponding to a corner portion on a side where the second corner portion 55 of the groove 50 is located is cut out, and has a shape that does not inhibit the insertion of the balance weight 60 through the opening 58 of the groove 50. In addition, a side portion of the body section 61 on a side where the first side wall surface 52 is located is formed not in a shape complementary to the groove shape of the groove 50, but in a shape that creates a gap between itself and the first side wall surface 52, and is shaped such that a portion corresponding to a corner portion on a side where the first corner portion 54 of the groove 50 is located is cut out. That is, the side portion on the first side wall surface 52 side of the body section 61 has a shape that does not inhibit the insertion of the balance weight 60 through the opening 58 of the groove 50.

More specifically, as illustrated for example in FIGS. 4, 6 and 7, the body section 61 has a rear surface 62 that faces the bottom surface 51 of the groove 50, a front surface 63 that is positioned on the side opposite to the rear surface 62 and faces the opening 58 of the groove 50, a first side surface 64 that is connected to the rear surface 62 and the front surface 63 and faces the first side wall surface 52 of the groove 50, a second side surface 65 that is connected to the rear surface 62 and the front surface 63, positioned on the side opposite to the first side surface 64, and faces the second side wall surface 53 of the groove 50, and a pair of circumferential side surfaces 66 that are connected to the rear surface 62 and the front surface 63, are connected to the first side surface 64 and the second side surface 65, and face the circumferential direction C of the groove 50.

The front surface 63 and the rear surface 62 are formed such that they become approximately parallel to each other. As illustrated in FIG. 4, a length Lw1 (see FIG. 6) from a ridge E1, which is on a side where the first side surface 64 is located, of the front surface 63 to a ridge, which is on a side where the second side surface 65 is located, of the front surface 63 is set such that it is slightly shorter than the width of the opening 58 of the groove 50.

As illustrated in FIG. 4 and FIG. 6, the first side surface 64 includes: a perpendicular surface 64*a* that is substantially perpendicularly connected to the front surface 63; and a first inclined surface 64*b* that extends from the perpendicular surface 64*a* and is connected to the rear surface 62 while being inclined in a direction toward the second side surface 65. This configuration of the first side surface 64 allows the balance weight 60 to be inserted into the groove 50 without making the first side surface 64 contact an opening edge on the first side wall surface 52 side of the groove 50.

The second side surface 65 includes: an abutting surface 65*a* that extends from the front surface 63 toward the rear surface 62 while being inclined in a direction away from the first side surface 64; and a second inclined surface 65*b* that extends from the abutting surface 65*a* and is connected to the rear surface 62 while being inclined in a direction toward the first side surface 64. The abutting surface 65*a* is formed such that its angle of inclination is approximately the same as the angle of inclination of the second side wall surface 53 of the groove 50, and it is possible for the abutting surface 65*a* to make surface contact with the second side wall surface 53.

As illustrated in FIG. 7, the pair of circumferential side surfaces 66 are formed such that they are substantially perpendicular to the bottom surface 62 and the front surface 63, and are approximately parallel to each other. For example, the pair of circumferential side surfaces 66 are portions to serve as a portion to be gripped by an operator when the operator inserts the balance weight 60 into the groove 50.

As illustrated in FIGS. 4, 6, and 7, the engagement protrusion 71 of the balance weight 60 is formed such that it protrudes from the rear surface 62 of the body section 61, and forms a shape that is generally complementary to the engagement recess 56 of the groove 50. The engagement protrusion 71 is formed as a projecting section that extends in a direction (the groove widthwise direction of the groove 50) connecting the side where the first side surface 64 is located and the side where the second side surface 65 is located, for example.

The balance weight 60 is provided with a through-hole 68 that penetrates the body section 61, and that is opened toward the first side wall surface 52 of the groove 50. The through-hole 68 is opened at the front surface 63 of the body section 61 and at the first inclined surface 64*b* of the first side surface 64, for example. The through-hole 68 is provided with a female thread portion, for example. As illustrated in FIG. 4, the retaining screw member 80 as the retaining member is disposed in a screwed (inserted) state in the through-hole 68 having the female thread portion.

Figure 9:
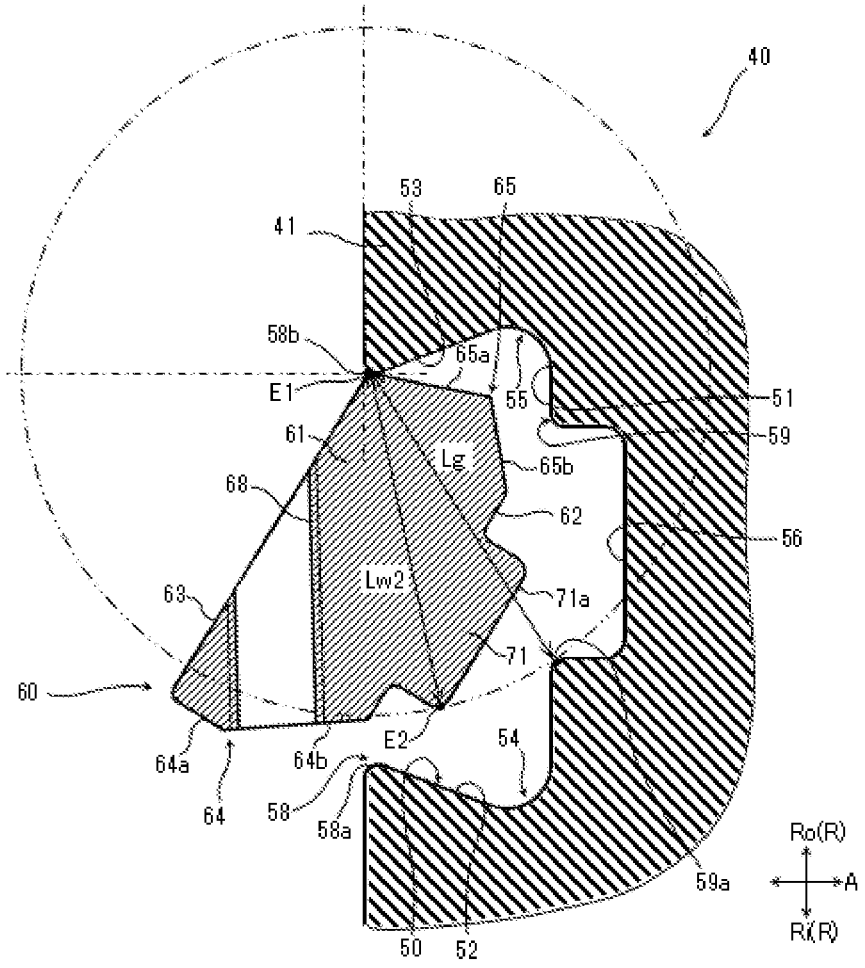
FIG. 9 is an explanatory diagram illustrating an example of the method of insertion of the balance weight into the groove in the turbine wheel according to the first embodiment of the present invention.

In addition, the balance weight 60 is formed such that a length Lw2 (see FIG. 6) from the ridge E1, which is located between the front surface 63 and the second side surface 65, of the body section 61 to an end portion E2, which is on a side where the first side surface 64 is located, of a tip surface 71*a* of the engagement protrusion 71 is shorter than the length Lg (see FIG. 5) from the opening edge 58*b* on the second side wall surface 53 side of the opening 58 of the groove 50 to the end portion 59*a* on the first side wall surface 52 side of the opening edge 59 of the engagement recess 56 (see FIG. 9 mentioned below also). This allows the balance weight 60 to be inserted into the groove 50 without making the engagement protrusion 71 contact the opening edge 59 of the engagement recess 56 of the groove 50.

Note that, for example, the length between the pair of circumferential side surfaces 66 of the balance weight 60 may vary. In this case, it is possible to ensure balance weights having different weights.

As illustrated in FIG. 4, the retaining screw member 80 contacts the first corner portion 54 of the first side wall surface 52 of the groove 50 in a state of being inserted in the through-hole 68 of the balance weight 60, thereby causing the second side surface 65 (the abutting surface 65*a*) of the body section 61 of the balance weight 60 to abut against the second side wall surface 53 of the groove 50 and the balance weight 60 to be retained in the groove 50. As illustrated in FIGS. 4 and 8, the retaining screw member 80 includes: a body section 81 having a male thread portion; and a tip section 82 that is formed integrally on one side of the body section 81 and has a curved surface. The tip section 82 is formed such that it makes line contact with a part of the concave curved surface of the first corner portion 54 of the groove 50. For example, a shape profile of the tip section 82 in a meridional plane cross-section has a convex curved shape having a radius of curvature approximately the same as the radius of curvature of the cross-sectional shape of the concave curved surface of the first corner portion 54.

Next, an example of the procedure of attachment of the balance weight into the groove in the turbine wheel according to the first embodiment of the present invention is explained by using FIGS. 4 and 9. FIG. 9 is an explanatory diagram illustrating an example of the method of insertion of the balance weight into the groove in the turbine wheel according to the first embodiment of the present invention.

First, as illustrated in FIG. 9, the ridge E1 between the front surface 63 and the second side surface 65 of the body section 61 of the balance weight 60 is caused to contact on the opening edge 58*b* on the second side wall surface 53 side of the opening 58 of the groove 50. In this state, the balance weight 60 is turned about the ridge E1 as the turning axis toward the bottom surface 51 of the groove 50. At this time, the engagement protrusion 71 of the balance weight 60 relatively shifts along the engagement recess 56 of the groove 50. Thereby, the body section 61 of the balance weight 60 is arranged between the first side wall surface 52 and second side wall surface 53 of the groove 50, and the engagement protrusion 71 of the balance weight 60 is arranged in the engagement recess 56 of the groove 50.

In the present embodiment, the length Lw2 of the balance weight 60 from the ridge E1 to the end portion E2 on the first side surface 64 side of the tip surface 71*a* of the engagement protrusion 71 is set shorter than the length Lg of the groove 50 from the opening edge 58*b* on the second side wall surface 53 side of the opening 58 to the end portion 59*a* on the first side wall surface 52 side of the opening edge 59 of the engagement recess 56. Accordingly, it is possible to insert the balance weight 60 into the groove 50 without making the engagement protrusion 71 of the balance weight 60 contact the opening edge 59 of the engagement recess 56 of the groove 50.

Next, as illustrated in FIG. 4, the retaining screw member 80 is screwed (inserted) into the through-hole 68 of the balance weight 60 in which the female thread portion is formed, and the tip section 82 of the retaining screw member 80 is pressed against the concave curved surface of the first corner portion 54 of the groove 50. By further screwing the retaining screw member 80 into the through-hole 68, the balance weight 60 shifts toward the second side wall surface 53 of the groove 50 along the retaining screw member 80. Eventually, the abutting surface 65*a* of the second side surface 65 of the balance weight 60 makes surface contact with the second side wall surface 53 of the groove 50.

In this manner, in the present embodiment, the retaining screw member 80 contacts the first corner portion 54 on the first side wall surface 52 side of the groove 50 in a state of being inserted in the through-hole 68 of the balance weight 60, thereby causing the abutting surface 65*a* of the balance weight 60 to make surface contact with (abut against) the second side wall surface 53 of the groove 50. As a result, the shift of the balance weight 60 in the radial direction R (in the groove widthwise direction of the groove 50) within the groove 50 is restricted, and the balance weight 60 is retained in the groove 50. In addition, the engagement protrusion 71 of the balance weight 60 engages with the engagement recess 56 of the groove 50, thereby restricting the shift of the balance weight 60 within the groove 50 in the circumferential direction C (in the extending direction of the groove 50). Accordingly, it is possible to fix the balance weight 60 in the groove 50 of the turbine wheel 40 without crimping the turbine wheel 40.

As mentioned above, according to the first embodiment of the turbine wheel according to the present invention, the engagement protrusion 71 of the balance weight 60 engages with the engagement recess 56 of the groove 50 of the turbine wheel 40, thereby restricting the shift of the balance weight 60 in the circumferential direction C within the groove 50. In this way, the shift of the balance weight 60 is restricted also by the engagement protrusion 71 in addition to fixation by the retaining screw member 80, and therefore the balance weight 60 can be firmly fixed. Thus, it becomes unnecessary to crimp the turbine wheel 40 in order to fix the balance weight 60. Accordingly, it is possible to suppress a residual tensile stress caused in the turbine wheel 40 by fixing the balance weight 60.

In addition, according to the present embodiment, the length Lw2 from the ridge E1, which is located between the front surface 63 and the second side surface 65, of the body section 61 to the end portion E2, which is closer to the first side surface 64, of the tip surface 71*a* of the engagement protrusion 71 in the balance weight 60 is set shorter than the length Lg from the opening edge 58*b*, which is closer to the second side wall surface 53, of the opening 58 to the end portion 59*a*, which is closer to the first side wall surface 52, of the opening edge 59 of the engagement recess 56 in the groove 50, and thus it is possible to insert the balance weight 60 into the groove 50 from any position, in the circumferential direction C, of the opening 58 of the groove 50 of the turbine wheel 40.

Furthermore, according to the present embodiment, the body section 61 and engagement protrusion 71 of the balance weight 60 are formed integrally, and thus the attachment of the balance weight 60 in the groove 50 is easy as compared with a configuration in which a body section and an engagement protrusion of a balance weight are separate members. That is, the integral structure of the body section 61 and engagement protrusion 71 of the balance weight 60 does not require assembly work of the balance weight 60 itself. As a result, the integral structure can avoid the falling of an engagement protrusion 71 from a body section 61, which may occur in a case where a body section 61 and an engagement protrusion 71 are separate members.

In addition, according to the present embodiment, the first corner portion 54 of the groove 50 is formed as a concave curved surface, and the tip section 82 of the retaining screw member 80 is formed such that it makes line contact with a portion of the concave curved surface of the first corner portion 54 of the groove 50. Accordingly, it is possible to suppress a residual tensile stress caused in the portion of the first corner portion 54 of the groove 50 with which the retaining screw member 80 makes contact.

Second Embodiment

Figure 10:
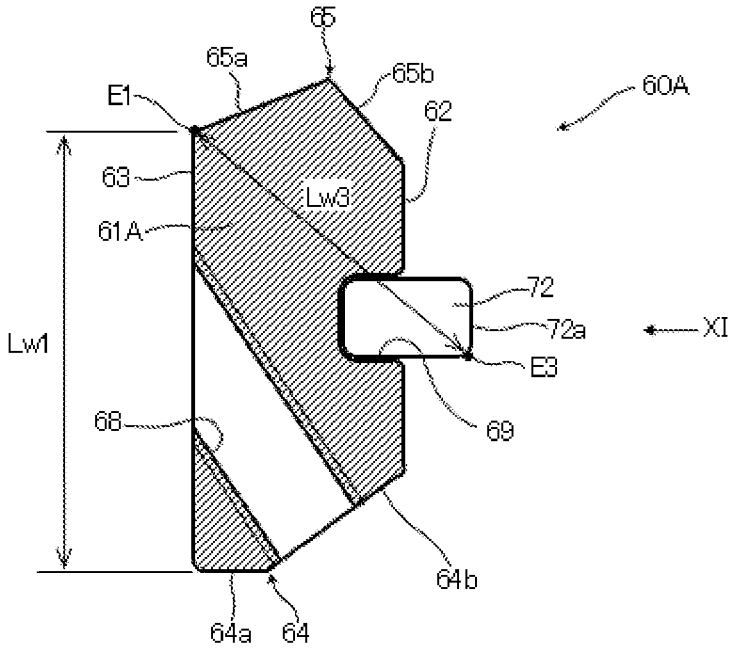
FIG. 10 is a cross-sectional diagram illustrating a balance weight of a turbine wheel according to a second embodiment of the present invention.
Figure 11:
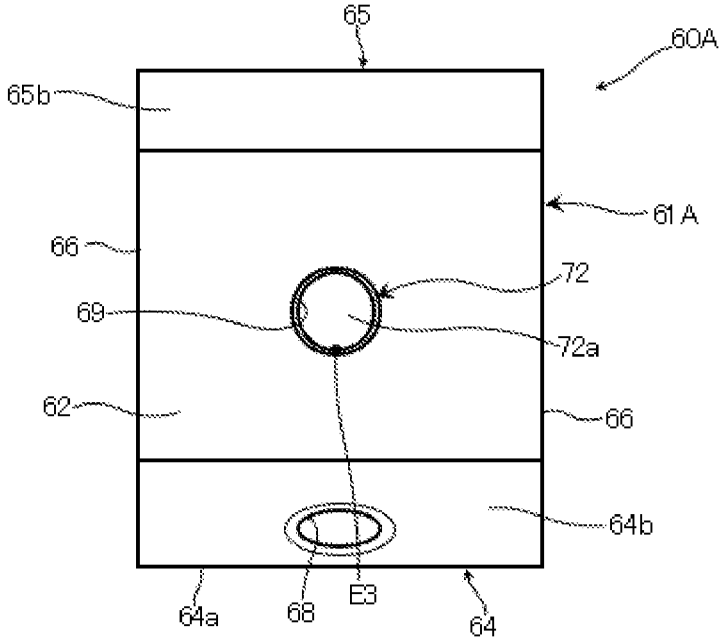
FIG. 11 is a diagram of the balance weight of the turbine wheel according to the second embodiment of the present invention illustrated in FIG. 10 as seen in the direction of an arrow XI.

Next, a turbine wheel of a second embodiment according to the present invention is explained by using FIGS. 10 and 11. FIG. 10 is a cross-sectional diagram illustrating a balance weight of the turbine wheel according to the second embodiment of the present invention. FIG. 11 is a diagram of the balance weight of the turbine wheel according to the second embodiment of the present invention illustrated in FIG. 10 as seen in the direction of an arrow XI. Note that since the reference characters in FIGS. 10 and 11 that are the same as reference characters illustrated in FIGS. 1 to 9 denote similar portions, detailed explanations thereof are omitted.

While the body section 61 and engagement protrusion 71 of the balance weight 60 in the first embodiment are formed integrally (see FIG. 6), the turbine wheel according to the second embodiment of the present invention illustrated in FIGS. 10 and 11 has a configuration including a body section 61A and an engagement protrusion 72 of a balance weight 60A as separate members.

Specifically, the balance weight 60A includes: the body section 61A having the through-hole 68 and a fitting recess 69; and a pin 72 attached to the fitting recess 69 of the body section 61A by being fit thereto. Similarly to the body section 61 of the balance weight 60 of the first embodiment, the body section 61A has the rear surface 62, the front surface 63, the first side surface 64, the second side surface 65 and the pair of circumferential side surfaces 66. Similarly to the first embodiment, the first side surface 64 includes the perpendicular surface 64*a* and the first inclined surface 64*b*. Similarly to the first embodiment, the second side surface 65 includes the abutting surface 65*a* and the second inclined surface 65*b*. The fitting recess 69 is provided in an approximately middle portion of the rear surface 62. The fitting recess 69 has a circular cross-section shape, for example. The pin 72 is a member separate from the body section 61A, and functions as an engagement protrusion to engage with any one of the engagement recesses 56 of the groove 50. The pin 72 has a circular transverse cross-section shape, for example.

The balance weight 60A is formed such that a length Lw3 from the ridge E1, which is located between the front surface 63 and the second side surface 65, of the body section 61A to an end portion E3, which is on a side where the first side surface 64 is located, of the tip surface 72*a* of the pin 72 as the engagement protrusion is shorter than the length Lg (see FIG. 5) from the opening edge 58*b* on the second side wall surface 53 side of the opening 58 of the groove 50 to the end portion 59*a* on the first side wall surface 52 side of the opening edge 59 of the engagement recess 56. This allows the balance weight 60A to be inserted into the groove 50 without making the pin 72 as the engagement protrusion contact the opening edge 59 of the engagement recess 56 of the groove 50.

According to the second embodiment of the turbine wheel according to the present invention mentioned above, similarly to the first embodiment mentioned before, the pin 72 as the engagement protrusion of the balance weight 60A engages with the engagement recess 56 of the groove 50 of the turbine wheel 40, thereby restricting the shift of the balance weight 60A in the circumferential direction C within the groove 50. As a result, it becomes unnecessary to crimp the turbine wheel 40 in order to fix the balance weight 60A. Accordingly, it is possible to suppress a residual tensile stress caused in the turbine wheel 40 by fixing the balance weight 60A.

Third Embodiment

Figure 12:
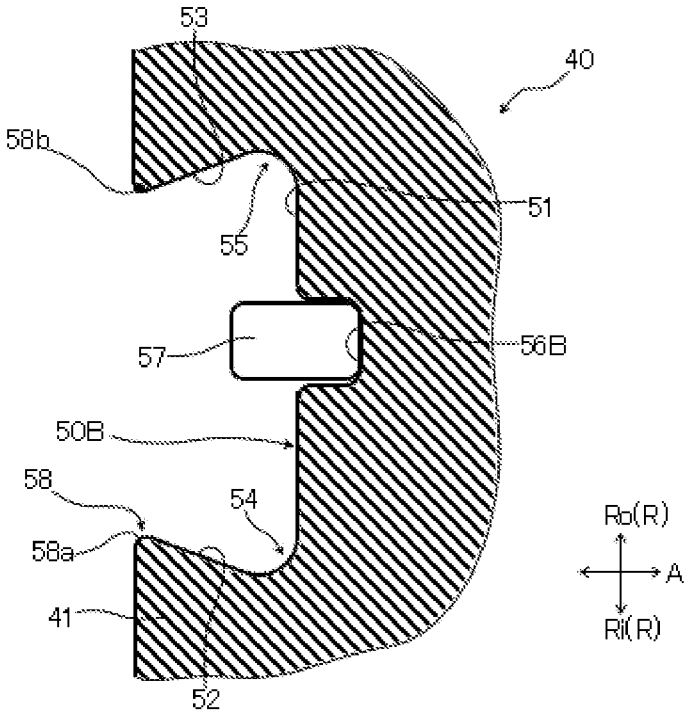
FIG. 12 is a cross-sectional diagram illustrating a groove of a turbine wheel according to a third embodiment of the present invention.
Figure 13:
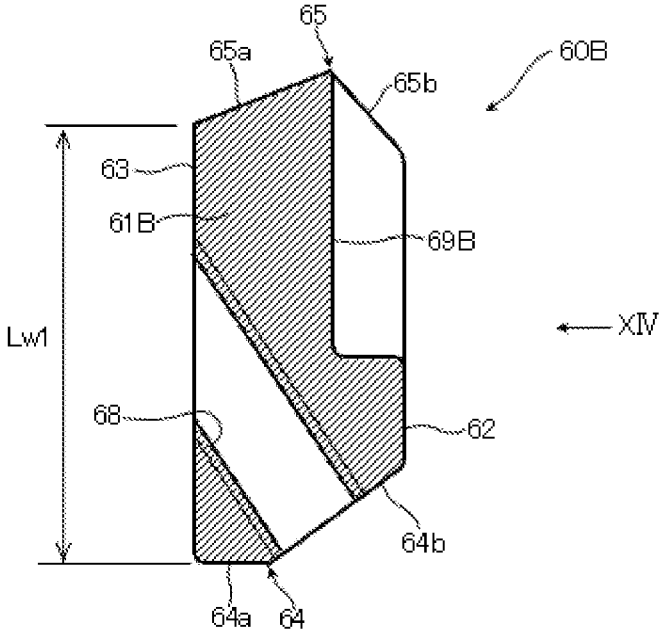
FIG. 13 is a cross-sectional diagram illustrating a balance weight of the turbine wheel according to the third embodiment of the present invention.
Figure 14:
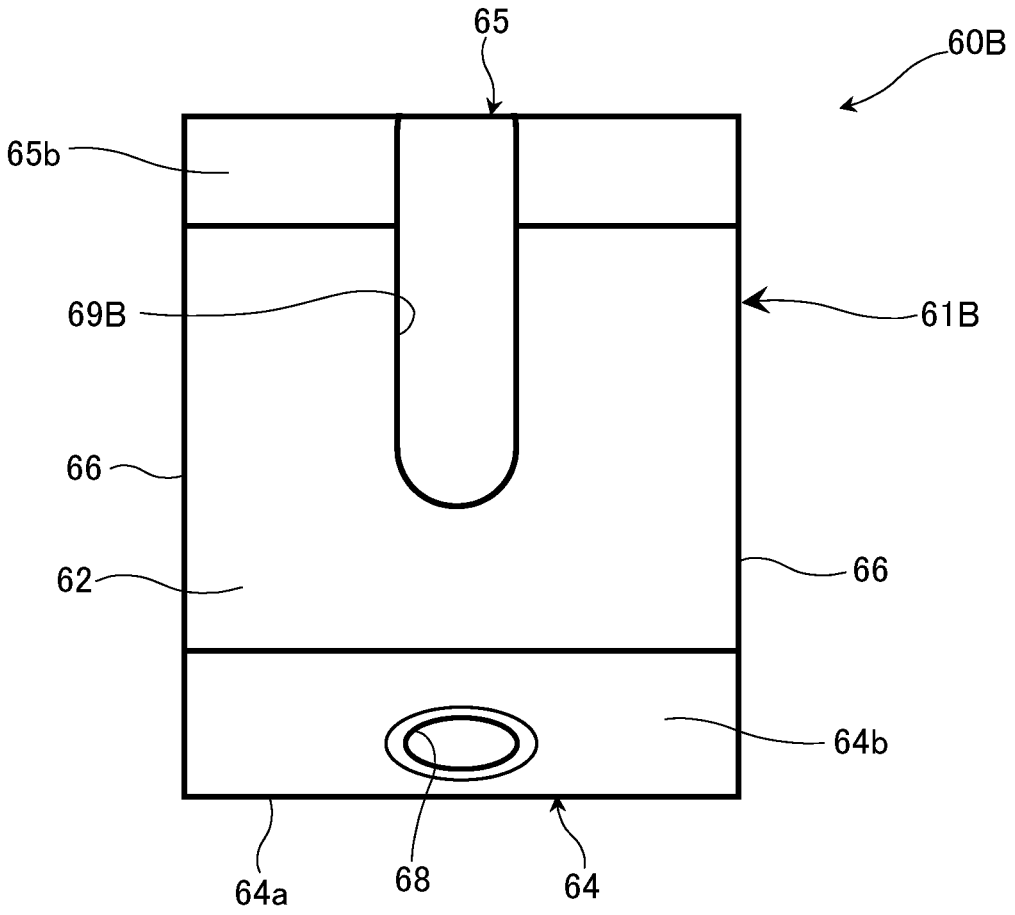
FIG. 14 is a diagram of the balance weight of the turbine wheel according to the third embodiment of the present invention illustrated in FIG. 13 as seen in the direction of an arrow XIV.

Next, the configuration and structure of a turbine wheel according to a third embodiment of the present invention are explained by using FIGS. 12 to 14. FIG. 12 is a cross-sectional diagram illustrating a groove of the turbine wheel according to the third embodiment of the present invention. FIG. 13 is a cross-sectional diagram illustrating a balance weight of the turbine wheel according to the third embodiment of the present invention. FIG. 14 is a diagram of the balance weight of the turbine wheel according to the third embodiment of the present invention illustrated in FIG. 13 as seen in the direction of an arrow XIV. Note that since the reference characters in FIGS. 12 to 14 that are the same as reference characters illustrated in FIGS. 1 to 11 denote similar portions, detailed explanations thereof are omitted.

A difference of the third embodiment of the turbine wheel according to the present invention illustrated in FIGS. 12 to 14 from the first embodiment is that the recessed shape and the projecting shape in engagement between the groove and the balance weight in the turbine wheel 40 are interchanged. That is, in the first embodiment, the engagement protrusion 71 of the balance weight 60 engages with the engagement recess 56 of the groove 50 of the turbine wheel 40, thereby restricting the shift of the balance weight 60 in the circumferential direction C within the groove 50 (see FIG. 4). On the other hand, in the third embodiment, an engagement groove 69B of a balance weight 60B engages with a pin 57 as an engagement protrusion of a groove 50B, thereby restricting the shift of the balance weight 60B in the circumferential direction C within the groove 50B.

Specifically, as illustrated in FIG. 12, the bottom surface 51 of the groove 50B is provided with a plurality of fitting recesses 56B at intervals in the circumferential direction C. A pin 57 can be fit to and fixed to each fitting recess 56B. The pin 57 protrudes from the bottom surface 51 of the groove 50B, engages with the engagement groove 69B of the balance weight 60B, and functions as an engagement protrusion that restricts the shift of the balance weight 60B in the circumferential direction C within the groove 50B. The pin 57 may be fit only to a fitting recess 56B corresponding to the attachment position of the balance weight 60B among the plurality of fitting recesses 56B of the groove 50B.

As illustrated in FIGS. 13 and 14, in the balance weight 60B, the rear surface 62 of a body section 61B is provided with the engagement groove 69B. The engagement groove 69B extends toward the first side surface 64 from the end edge closer to the second side surface 65 to the position of a middle portion, and is opened at the rear surface 62 and the second side surface 65. The engagement groove 69B engages with the pin 57 fitted to the fitting recess 56B of the groove 50B, and has the function of restricting the shift of the balance weight 60B in the circumferential direction C within the groove 50B.

Figure 15:
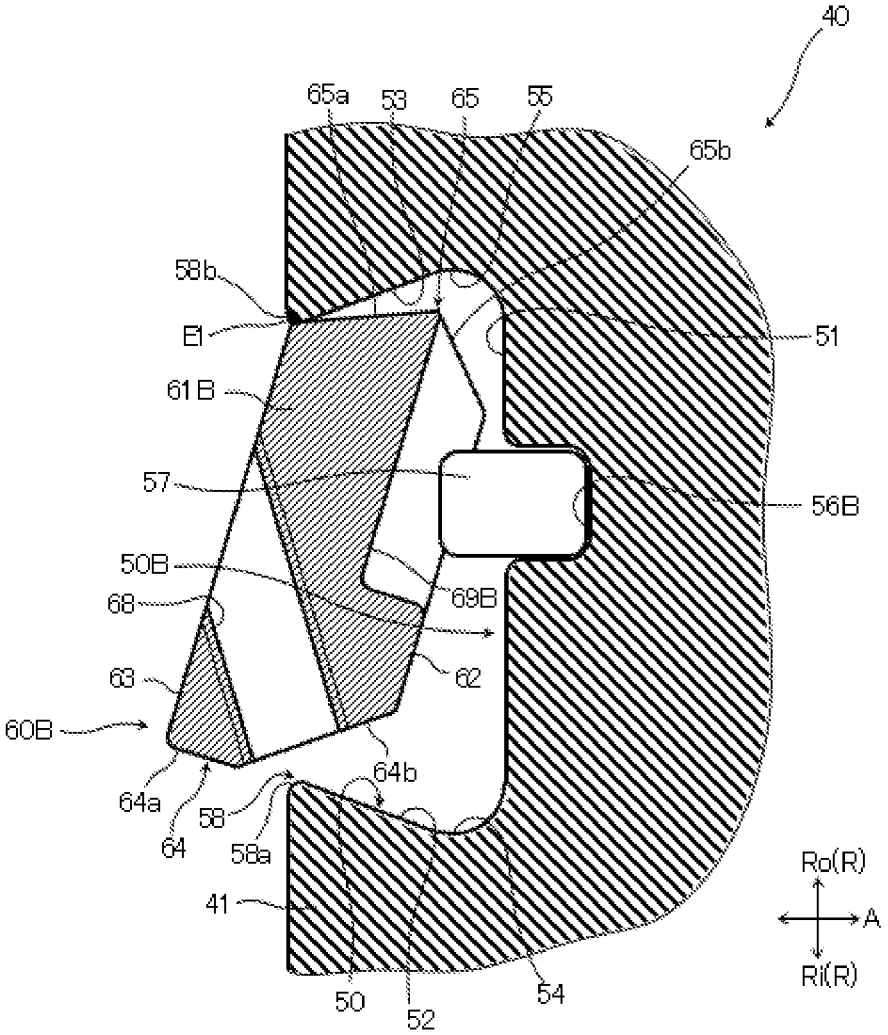
FIG. 15 is an explanatory diagram illustrating an example of the method of insertion of the balance weight into the groove in the turbine wheel according to the third embodiment of the present invention.

Next, an example of the procedure of attachment of the balance weight into the groove in the turbine wheel according to the third embodiment of the present invention is explained by using FIG. 15. FIG. 15 is an explanatory diagram illustrating an example of the method of insertion of the balance weight into the groove in the turbine wheel according to the third embodiment of the present invention.

As illustrated in FIG. 15, the ridge E1 of the body section 61B of the balance weight 60B, which is located between the front surface 63 and the second side surface 65, is caused to contact on the opening edge 58*b*, closer to the second side wall surface 53, of the opening 58 of the groove 50B. In this state, the balance weight 60B is turned toward the bottom surface 51 of the groove 50B about the ridge E1 as the turning axis.

In the present embodiment, the pin 57 fitted to the fitting recess 56B of the groove 50B relatively shifts along the engagement groove 69B of the body section 61B of the balance weight 60B. Thereby, the balance weight 60B is inserted into the groove 50B without making the second side surface 65 and rear surface 62 of the balance weight 60B contact the pin 57 as the engagement protrusion of the groove 50B.

Similarly to the first embodiment, in the present embodiment also, the retaining screw member 80 (see FIG. 4) contacts the first corner portion 54 of the groove 50B closer to the first side wall surface 52 in a state of being inserted in the through-hole 68 of the balance weight 60B, thereby causing the abutting surface 65*a* of the balance weight 60B to make surface contact with the second side wall surface 53 of the groove 50B. As a result, the shift of the balance weight 60B in the radial direction R (in the groove widthwise direction of the groove 50) within the groove 50B is restricted, and the balance weight 60B is retained in the groove 50B. In addition, the engagement groove 69B of the balance weight 60B engages with the pin 57 fitted to the fitting recess 56B of the groove 50B, thereby restricting the shift of the balance weight 60B in the circumferential direction C (in the extending direction of the groove 50B)

within the groove 50B. Accordingly, it is possible to fix the balance weight 60B in the groove 50B without crimping the turbine wheel 40.

According to the third embodiment of the turbine wheel according to the present invention mentioned above, since the engagement groove 69B of the balance weight 60B engages with the pin 57 as the engagement protrusion of the groove 50B of the turbine wheel 40, the shift of the balance weight 60B in the circumferential direction C within the groove 50B is restricted, and thus it becomes unnecessary to crimp the turbine wheel 40 in order to fix the balance weight 60B. Accordingly, it is possible to suppress a residual tensile stress caused in the turbine wheel 40 by fixing the balance weight 60B.

Other Embodiments

Note that the present invention is not limited to the first to third embodiments mentioned above, but includes various modification examples. The embodiments described above are explained in detail in order to explain the present invention in an easy-to-understand manner, and the present invention is not necessarily limited to embodiments including all the configurations explained. For example, some of the configurations of an embodiment can be replaced with configurations of another embodiment, and configurations of an embodiment can also be added to the configurations of another embodiment. In addition, some of the configurations of individual embodiments can have other additional configurations, or can be removed or replaced with other configurations.

For example, in the first embodiment mentioned above, the engagement protrusion 71 of the balance weight 60 is formed as a projecting section that extends in the direction connecting the side where the first side surface 64 is located and the side where the second side surface 65 is located (in the groove widthwise direction of the groove 50). However, the engagement protrusion 71 may have any shape as long as the engagement protrusion 71 engages with the engagement recess 56 of the groove 50 of the turbine wheel 40, and thereby restricts the shift of the balance weight 60 in the circumferential direction C. It is also possible to form the cross-sectional shape of the engagement protrusion 71 in a circular, rectangular or polygonal shape, for example.

In addition, in the first and second embodiments mentioned above, the engagement recess 56 is formed as a groove (engagement groove) that extends in the groove widthwise direction of the groove 50. However, the engagement recess 56 may have any shape as long as the engagement recess 56 engages with the engagement protrusion 71 of the balance weight 60 or the pin 72 of the balance weight 60A, and thereby can restrict the shift of the balance weights 60 and 60A in the circumferential direction C.

What is claimed is:

1. A turbine wheel provided with a groove having a bottom surface extending circumferentially and a pair of side wall surfaces forming an opening, the turbine wheel comprising:

a balance weight that is arranged in the groove, the balance weight being configured to be insertable from any circumferential position of the opening of the groove, the balance weight having a through-hole opened toward one of the pair of side wall surfaces of the groove; and a retaining member that contacts a portion of the one of the pair of side wall surfaces of the groove in a state of being inserted in the through-hole of the balance weight, to thereby cause the balance weight to abut against other one of the pair of side wall surfaces of the groove and be retained in the groove, wherein the groove has a plurality of engagement recesses provided at intervals in a circumferential direction at the bottom surface or an engagement protrusion protruding from the bottom surface, the engagement protrusion being fitted to one of a plurality of fitting recesses provided at intervals in the circumferential direction at the bottom surface, and the balance weight has an engagement protrusion that engages with one of the engagement recesses of the groove to restrict a circumferential shift of the balance weight in the groove or an engagement groove that engages with the engagement protrusion of the groove to restrict a circumferential shift of the balance weight in the groove.

2. The turbine wheel according to claim 1, wherein the groove has the engagement recesses, and the balance weight includes a body section having the through-hole, and the engagement protrusion formed integrally with the body section.

3. The turbine wheel according to claim 1, wherein the groove has the engagement recesses, and the balance weight includes a body section that has the through-hole and a fitting recess, the fitting recess being provided in a portion facing the bottom surface of the groove, and the engagement protrusion fitted to the fitting recess of the body section.

4. The turbine wheel according to claim 2, wherein the balance weight has a rear surface that faces the bottom surface of the groove, a front surface that is positioned on a side opposite to the rear surface, and faces the opening of the groove, a first side surface that is connected to the rear surface and the front surface, and faces the one of the pair of side wall surfaces of the groove, and a second side surface that is connected to the rear surface and the front surface, is positioned on a side opposite to the first side surface, and faces the other one of the pair of side wall surfaces of the groove, and the balance weight is formed such that a length from a ridge located between the front surface and the second side surface to an end portion of a tip surface of the engagement protrusion of the balance weight is shorter than a length from an opening edge of the opening of the groove to an end portion of an opening edge of one of the engagement recesses of the groove, the end portion of the tip surface being on a side where the first side surface is located, the opening edge of the opening of the groove being on a side where the one of the pair of side wall surfaces is located, the end portion of the opening edge of one of the engagement recesses being on a side where the other one of the pair of side wall surfaces is located.

5. The turbine wheel according to claim 1, wherein a corner portion located on a side of the one of the pair of side wall surfaces in the groove is formed in a concave curved surface, and the retaining member is formed such that a tip section of the retaining member makes line contact with a portion of the concave curved surface of the corner portion of the groove.

* * * * *